US010710235B1

(12) United States Patent
Cantlon

(10) Patent No.: US 10,710,235 B1
(45) Date of Patent: Jul. 14, 2020

(54) TIERED TIP OUT ASSEMBLY FOR ROUND SHANK DRILL BITS

(71) Applicant: Jore Corporation, Ronan, MT (US)

(72) Inventor: Nathan C. Cantlon, Charlo, MT (US)

(73) Assignee: JORE CORPORATION, Ronan, MT (US)

( * ) Notice: Subject to any disclaimer, the term of this patent is extended or adjusted under 35 U.S.C. 154(b) by 5 days.

(21) Appl. No.: 15/944,661

(22) Filed: Apr. 3, 2018

Related U.S. Application Data

(60) Provisional application No. 62/481,036, filed on Apr. 3, 2017.

(51) Int. Cl.
*B65D 85/28* (2006.01)
*B25H 3/02* (2006.01)
*B25H 3/00* (2006.01)

(52) U.S. Cl.
CPC ..... *B25H 3/025* (2013.01); *B25H 3/003* (2013.01)

(58) Field of Classification Search
CPC ..... B65D 85/20; B65D 85/24; B25H 3/003; B25H 3/025
USPC ..... 206/1.5, 349, 372, 373, 379
See application file for complete search history.

(56) References Cited

U.S. PATENT DOCUMENTS 3,074,539 A * 1/1963 Rogovin ..... B25H 3/003 206/379
3,493,102 A * 2/1970 Belokin, Jr. ..... B25H 3/023 312/215
4,006,821 A * 2/1977 Sautter ..... B25H 3/003 206/379
6,547,074 B1 * 4/2003 Chen ..... B25H 3/003 206/379
8,196,742 B1 * 6/2012 Wang ..... B25H 3/003 206/379
2005/0178686 A1 * 8/2005 Pangerc ..... B25H 3/003 206/379
2006/0169614 A1 * 8/2006 Roesler ..... B25H 3/003 206/379

(Continued)

OTHER PUBLICATIONS

"Black Oxide Drill Bit Set (29-Piece)," RYOBI, Model # A10D29G, ©2019 Home Depot, <https://www.homedepot.com/p/RYOBI-Black-Oxide-Drill-Bit-Set-29-Piece-A10D29G/206264344> [retrieved Jul. 29, 2019], 6 pages.

(Continued)

*Primary Examiner* — Luan K Bui
(74) *Attorney, Agent, or Firm* — Christensen O'Connor Johnson Kindness PLLC

(57) ABSTRACT

A round shank tool holder assembly includes a storage case and first and second tip out tool holders each configured to removably receive a round shank tool therein and each pivotally secured within the storage case and moveable about a pivot axis between a stowed position and a deployed position, wherein the round shank tools remain visible in both the stowed and deployed positions. A first tool retention member is configured to substantially prevent axial movement of the first round shank tool when the first tip out tool holder is in the stowed position, and a second tool retention member configured to substantially prevent axial movement of the second round shank tool when the second tip out tool holder is in the stowed position, wherein the first tool retention member is defined by a first portion of the second tip out tool holder.

19 Claims, 9 Drawing Sheets

(56) References Cited

U.S. PATENT DOCUMENTS

| | | | | |
|---|---|---|---|---|
| 2006/0186007 | A1* | 8/2006 | Dost | B25H 3/003 206/379 |
| 2008/0011634 | A1* | 1/2008 | Lin | B25H 3/003 206/372 |

OTHER PUBLICATIONS

"Bosch BL20 20 Piece Black Oxide Fractional Drill Bits Set," Bosch, Model # BL20, ©2019 Toolorbit.com, <https://www.toolorbit.com/bosch-bl20-20-piece-black-oxide-fractional-drill-bits-set> [retrieved Jul. 29, 2019], 3 pages.

"Dewalt DW1361 Titanium Pilot Point Drill Bit Set, 21-Piece," DeWalt, Part No. DW1361, Dec. 16, 2010, <https://www.amazon.com/DEWALT-DW1361-Titanium-Pilot-21-Piece/dp/B004GIO0F8/ref=pd_bxgy_469_img_3?_encoding=UTF8&pd_rd_i=B004GIO0F8&pd_rd_r=385557ef-8538-11e8-af94-512c4a9e243e&pd_rd_w=6rUwD&pd_rd_wg=R71OJ&pf_rd_i=desktop-dp-sims&pf_rd_m=ATVPDKIKX0DER&pf_rd_p=3914568618330124508&pf_rd_r=YY0G7BAE0YNPJNM9G8SV&pf_rd_s=desktop-dp-sims&pf_rd_t=40701&psc=1&refRID=YY0G7BAE0YNP.

"Drill Index/US Size," ©2019 HUOT, NSN: 5140-00-277-8835, <https://www.huot.com/products/drill-indexus-size-5/> [retrieved Jul. 29, 2019], 2 pages.

* cited by examiner

TIERED TIP OUT ASSEMBLY FOR ROUND SHANK DRILL BITS

CROSS-REFERENCE TO RELATED APPLICATION

This application claims the benefit of U.S. Provisional Application No. 62/481,036 filed, Apr. 3, 2017, the disclosure of which is incorporated herein by reference in its entirety.

BACKGROUND

Tool accessories, such as drill bits, may be conveniently stored and organized within a case, a caddy, a storage box, etc. One such known storage device for drill bits is a drill index, which typically includes a tip out tool holder housed within a storage case. The drill index securely stores the drill bits in an organized manner. In a closed position, the indexed tools are secured within the tip out holders, and in an open position, the indexed tools are accessible for use. The closed and/or open position may be defined by the storage case and/or the tip out holder itself.

Tip out holders have been commonly used in the market for tools with hexagonal shanks. When the hexagonal shank is configured with a circumferential ball detent groove, the geometric feature of the shank can be used to retain the tool within the tip out holder. In other words, the tool is axially retained within the tip out holder until a predetermined axial force is exerted by the user to remove the tool from the holder.

Tip out holders have also been used for round shank products such as drill bits, but the configuration of the tool shank has limited practical applications. Round shank tools are essentially cylindrical in nature, so there is no geometric feature that can readily be used to retain the tools. In the instances where a tip out has been used with round shank tools, the tool storage case itself is commonly configured to help capture the round shank tools and prevent them from becoming dislodged from the tip out.

For instance, some prior art round shank drill indexes configure one side of the case to capture the tools when closed. However, in order to capture the tools, the case obscures visibility of the tools. Accordingly, the tools cannot be easily displayed in a retail setting. Some prior art round shank drill indexes are configured such that the larger tools are stacked over the smaller tools in order to contain the smaller tools in the case. In such designs, the tools are not organized in a manner that allows a user to easily see all the tool sizes as the larger tools obscure the view of the smaller tools.

Other prior art round shank drill indexes have been laid out in a book type configuration with the case acting as the front and back covers and each row of tools acting like pages. The primary disadvantage to this book type configuration is that the end user must "page" through the rows of tools to gain access to the tools. In other words, the end user only has easy access to one row of tools at a time. The other disadvantage to this book type configuration is cost. The book layout uses several complicated parts to accomplish its indexing, and the component cost is prohibitive in smaller piece count sets.

Yet other prior art round shank drill indexes use a physical interference to retain the tool within the holder. For instance, the drill shank meets a feature in the holder that adds a friction contact to the tool. While effective to resist movement of the tools within the holder, this design is not without its drawbacks. The friction makes it harder to remove or replace the tools that are already difficult to grasp (especially the smaller sizes). As such, it can become hazardous for the end user. The tools are sharp, and installation or removal puts the user at risk for cuts or impaling their fingers. The friction feature can also fail to secure the tools in certain situations. If the storage case is closed and stored in a position where vibration or gravity can act upon it (such as during transportation to the work site), the tools can become dislodged.

Based on at least the foregoing, an improvement in round shank drill indexes can be appreciated.

SUMMARY

A round shank tool holder assembly includes a storage case, a first tip out tool holder, and a second tip out tool holder. The first tip out tool holder is configured to removably receive at least a first round shank tool therein and it is pivotally secured within the storage case and moveable about a first pivot axis between a stowed position and a deployed position, wherein the first tool remains visible in both the stowed and deployed positions. The second tip out tool holder is configured to removably receive at least a second round shank tool therein and it is pivotally secured within the storage case and moveable about a second pivot axis between a stowed position and a deployed position, wherein the second tool remains visible in both the stowed and deployed positions. A first tool retention member is configured to substantially prevent axial movement of the first round shank tool when the first tip out tool holder is in the stowed position, and a second tool retention member configured to substantially prevent axial movement of the second round shank tool when the second tip out tool holder is in the stowed position.

In one embodiment, the first tool retention member is defined by a first portion of the second tip out tool holder.

In another embodiment, the round shank tool holder assembly includes a deployment assembly configured to move the first tip out tool holder about the first pivot axis into the deployed position.

In yet another embodiment, the round shank tool holder assembly includes an interference assembly configured to substantially prevent the second tip out tool holder from being moved toward the deployed position with the first tip out tool holder in the stowed position.

A tool holder assembly includes a storage case, a first tip out tool holder configured to removably receive at least a first tool therein, wherein the first tip out tool holder is pivotally secured within the storage case and moveable about a first pivot axis between a stowed position and a deployed position, and a second tip out tool holder configured to removably receive at least a second tool therein. The second tip out tool holder is pivotally secured within the storage case and moveable about a second pivot axis between a stowed position and a deployed position. A first portion of the second tip out tool holder substantially prevents axial movement of the first tool when the first and second tip out tool holders are in the stowed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known structures or process steps have not been described in detail in order not to unnecessarily obscure various aspects of the present disclosure. Further, it will be appreciated that embodiments of the present disclosure may employ any combination of features described herein.

The present application includes references to directions, such as "front," "behind," "upward," "downward," "exterior," and "interior." These references and other similar references in the present application are only to assist in helping describe and understand the present invention and are not intended to limit the present invention to these directions.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. In an embodiment, "about," "approximately," etc., means plus or minus 5% of the stated value.

Although embodiments of the present disclosure are described as being suitable for round shank tools, it should be appreciated that the embodiments described herein may also be suitable for hex or other polygonal shaped tools. Also, references to "drill bit", "tool", or similar are understood to be interchangeable and are not meant to be limiting in nature.

Figure 1:
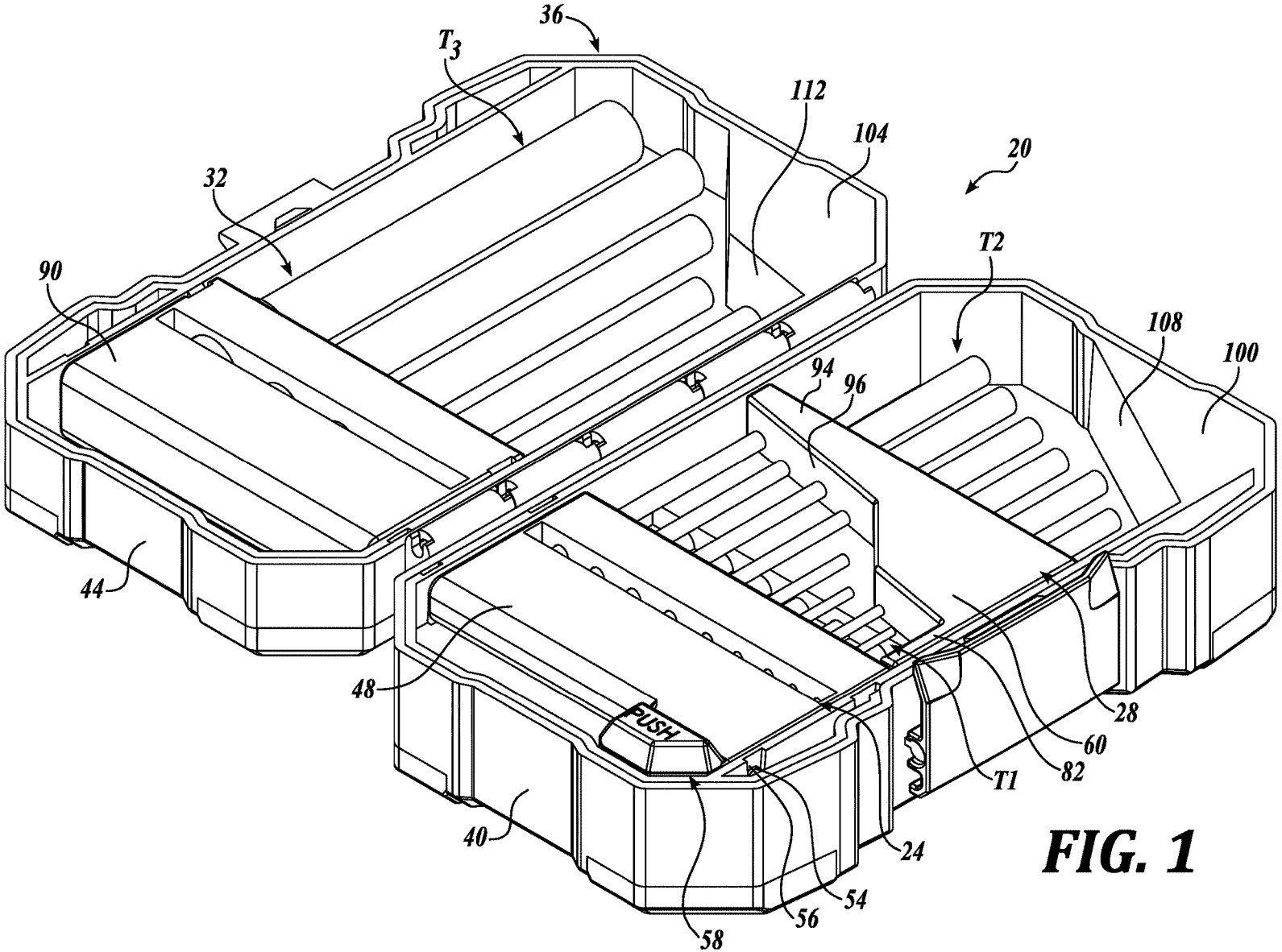
FIG. 1 is an isometric view of a round shank tool holder assembly formed in accordance with an exemplary embodiment of the present disclosure, wherein first, second, and third tip out tool holders of the round shank tool holder assembly are shown in a stowed position.
Figure 2:
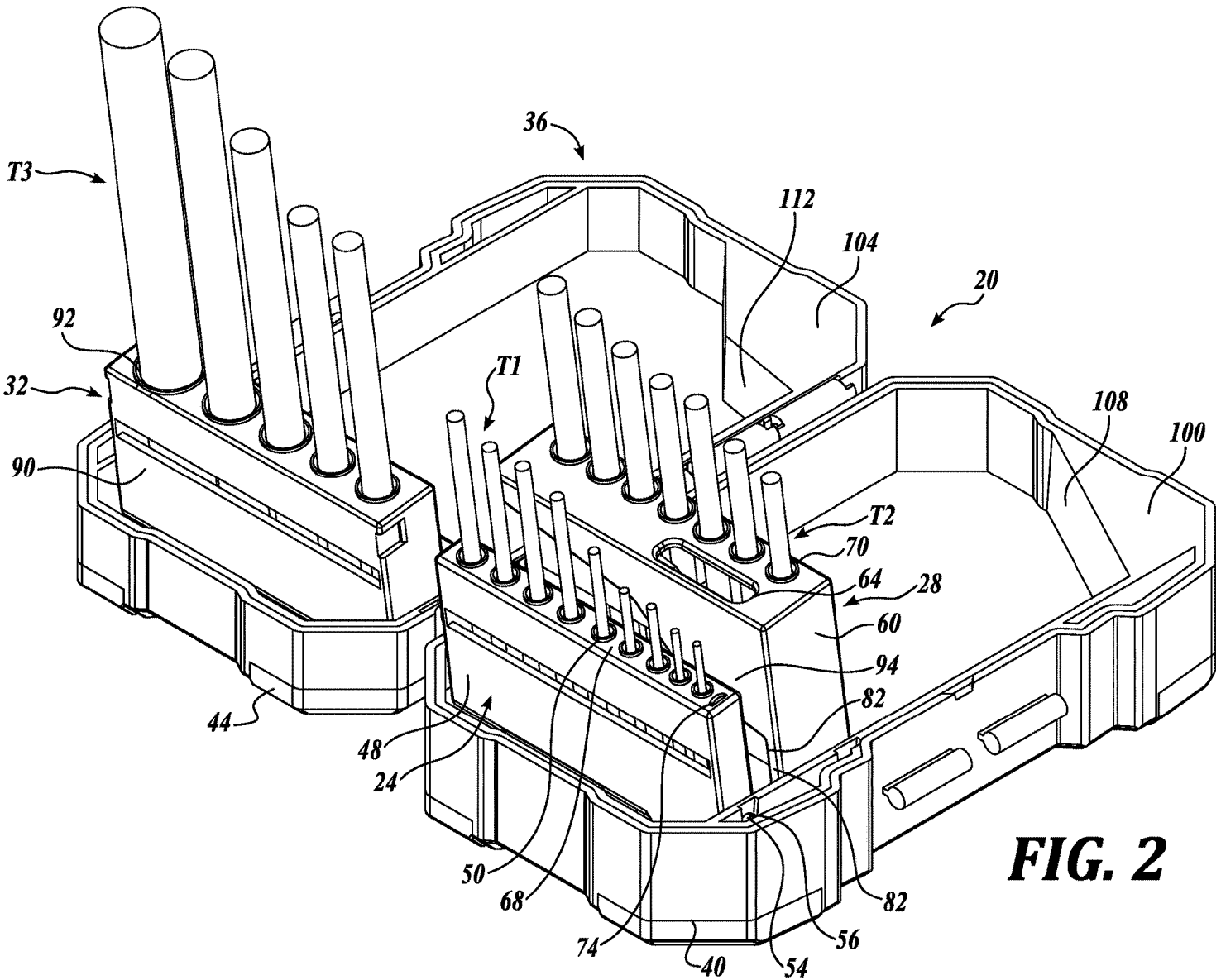
FIG. 2 is an isometric view of the round shank tool holder assembly of FIG. 1, wherein the first, second, and third tip out tool holders are shown in a deployed position.

FIGS. 1 and 2 depict an exemplary embodiment of a round shank tool holder assembly 20 having first, second, and third tip out tool holders 24, 28, and 32 configured to organize and stow round shank tools (T1, T2, and T3) within a storage case 36 in a manner that overcomes the issues identified with prior art configurations. The first, second, and third tip out tool holders 24, 28, and 32 are moveable between a stowed position within the storage case 36 (see FIG. 1), and a deployed, tiered position (see FIG. 2) for tool selection and removal.

The storage case 36 may be any structure suitable to enclose and retain the round shank tools within the tip out tool holders 24, 28, and 32 when stowed while also being suitable to securely display the tools within the tip out tool holders 24, 28, and 32 when deployed. Although many different configurations may be used, in the depicted embodiment, the storage case 36 includes a first housing portion 40 hingedly coupled to a second housing portion 44. The first and second housing portions 40 and 44 are substantially similar in shape, both portions being of a substantially rectangular shape with chamfered corners and having a depth to receive the tip out tool holders therein when stowed. The first and second housing portions 40 and 44 are hingedly coupled together along a long edge thereof such that the storage case 36 opens in a book-like manner with the first housing portion 40 positionable substantially adjacent to the second housing portion 44 in substantially the same plane (see FIG. 1). A suitable case locking assembly, such as a snap-fit assembly (not labeled), may be used to selectively secure the first housing portion 40 to the second housing portion 44 when the storage case 36 is closed.

The first, second, and third tip out tool holders 24, 28, and 32, and the manner in which they are moveably secured within the first and second housing portions 40 and 44, will now be described in detail with reference to FIGS. 1-4. The first tip out tool holder 24 includes a first tip out tool holder body 48 that is generally rectangular in overall shape and has a thickness or depth to house tools T1 received within tool openings 50 defined within an upper edge of the body 48. The tool openings 50 are appropriately sized to receive the correspondingly sized tools T1 (such as round shank tool bits having sizes between 1/16 and 9/64 inches).

Similarly, the second tip out tool holder 28 includes a second tip out tool holder body 60 that is generally rectangular in overall shape and has a thickness or depth to house tools T2 received within tool openings 70 defined within an upper edge of the body 60. The tool openings 70 are appropriately sized to receive the correspondingly sized tools T2 (such as round shank tool bits having sizes between 5/32 and 15/64 inches). Moreover, the third tip out tool holder 32 includes a third tip out tool holder body 90 that is generally rectangular in overall shape and has a thickness or depth to house tools T3 received within tool openings 92 defined within an upper edge of the body 90. The tool openings 92 are appropriately sized to receive the correspondingly sized tools T3 (such as round shank tool bits having sizes between ¼ and ½ inches).

Regarding the first tip out tool holder 24, the upper edge of the first tip out tool holder body 48 at the tool openings 50 surrounds and secures an upper portion of the tools T1 within the body 48. Corresponding interior tool openings or slots 52 (see FIG. 4) may be defined within an interior portion of the body 48 to secure a lower portion of the tools T1 in the body 48, i.e., such that the tools T1 are secured within the body 48 at first and second points. The inner diameter of the tool openings 50 and corresponding slots 52 is substantially the same as the outer diameter of the tools T1 such that the tools T1 are securely retained therein. At the same time, the inner diameter of the tool openings 50 and corresponding slots 52 is sufficiently large to allow the tools T1 to be easily removed by a user from the first tip out tool holder 24. In other words, a significant friction fit is not defined between the tip out tool holder 24 and the tools T1 to retain the tools therein. Rather, the tools T1 are substantially retained axially within the tip out tool holder 24 by other structure, later described.

The tools T1 may extend outwardly from the tool openings 50 a predetermined amount to suitably display each tool T1 when received within the first tip out tool holder body 48, as well as to provide a portion of the tool T1 that may be grasped for removal when the first tip out tool holder 24 is in the deployed position. The tools T2 and T3 are secured within the second and third tip out tool holders 28 and 32 in a substantially similar manner.

The first tip out tool holder 24 is hingedly or pivotally secured within the first housing portion 40 along its bottom elongated edge to move the tip out tool holder between the stowed and deployed positions. The first tip out tool holder body 48 is hingedly secured within the first housing portion 40 in any suitable manner, such as by rotatably securing first and second lateral protrusions 54 48 (only one shown in FIGS. 1 and 2) on the first tip out tool holder body within first and second corresponding protrusion openings 56 (only one shown in FIGS. 1 and 2) defined within opposite sides of the first housing portion 40. The second and third tip out tool holders 26 and 28 are pivotally secured within the first and second housing portions 40 and 44, respectively, in a substantially similar manner.

Figure 3A:
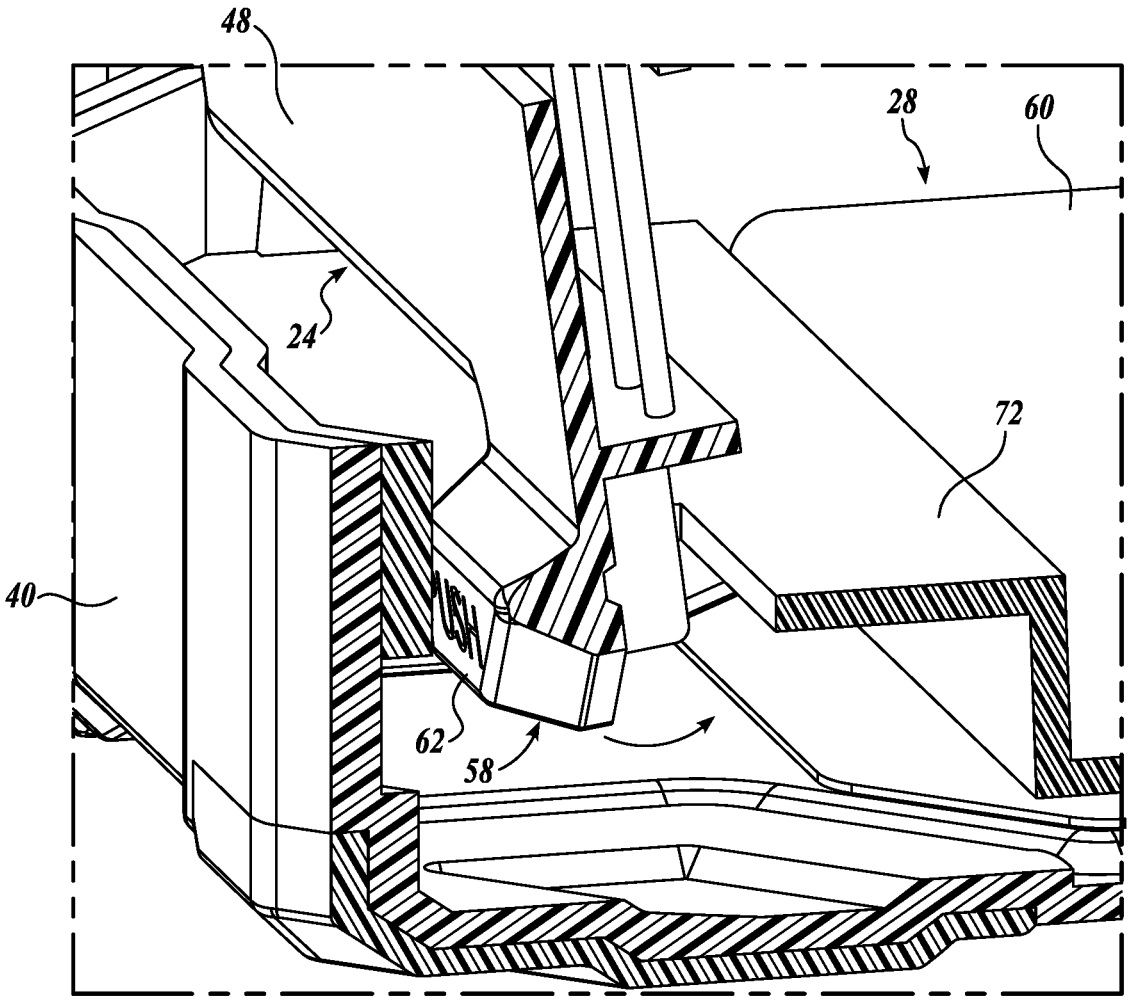
FIG. 3A is a cross-sectional view of a portion of the round shank tool holder assembly of FIG. 1, showing the first tip out tool holder moving into the deployed position.

A suitable deployment assembly 58 may be used to move the first tip out tool holder 24 into the deployed position, rather than having to grab the sharp ends of the tools T1 or a portion of the first tip out tool holder body 48 to pull the first tip out tool holder 24 outwards. Although any suitable assembly may be used, in the depicted embodiment, the deployment assembly 58 includes a push button 62 defined along and extending from the bottom edge of the first tip out tool holder body 48. The push button 62 is located off-center from the pivot axis of the first tip out tool holder 24, opposite the first tip out tool holder body 48, to act as a lever. Accordingly, depression of the push button 62 pivots the first tip out tool holder 24 in a counterclockwise direction about its pivot axis to move the first tip out tool holder 24 into the deployed position, as shown in FIG. 3A.

The first tip out tool holder 24 may be moved counterclockwise about its pivot axis until it passes the twelve o-clock position, or over the top center point of the pivot axis. A portion of the first tip out tool holder body 48 may engage the first housing portion 40 to substantially prevent further counterclockwise movement of the first tip out tool holder 24 after it reaches an over-center deployed position, such as about 105 degrees. For instance, as shown in FIG. 3A, the pushbutton 62 engages a first stopping member, or a first interior raised housing portion 72 to stop the first tip out tool holder 24 from moving further in the counterclockwise direction. In this manner, the first tip out tool holder 24 may rest securely in the over-center deployed position for access to the tools T1.

Figure 3B:
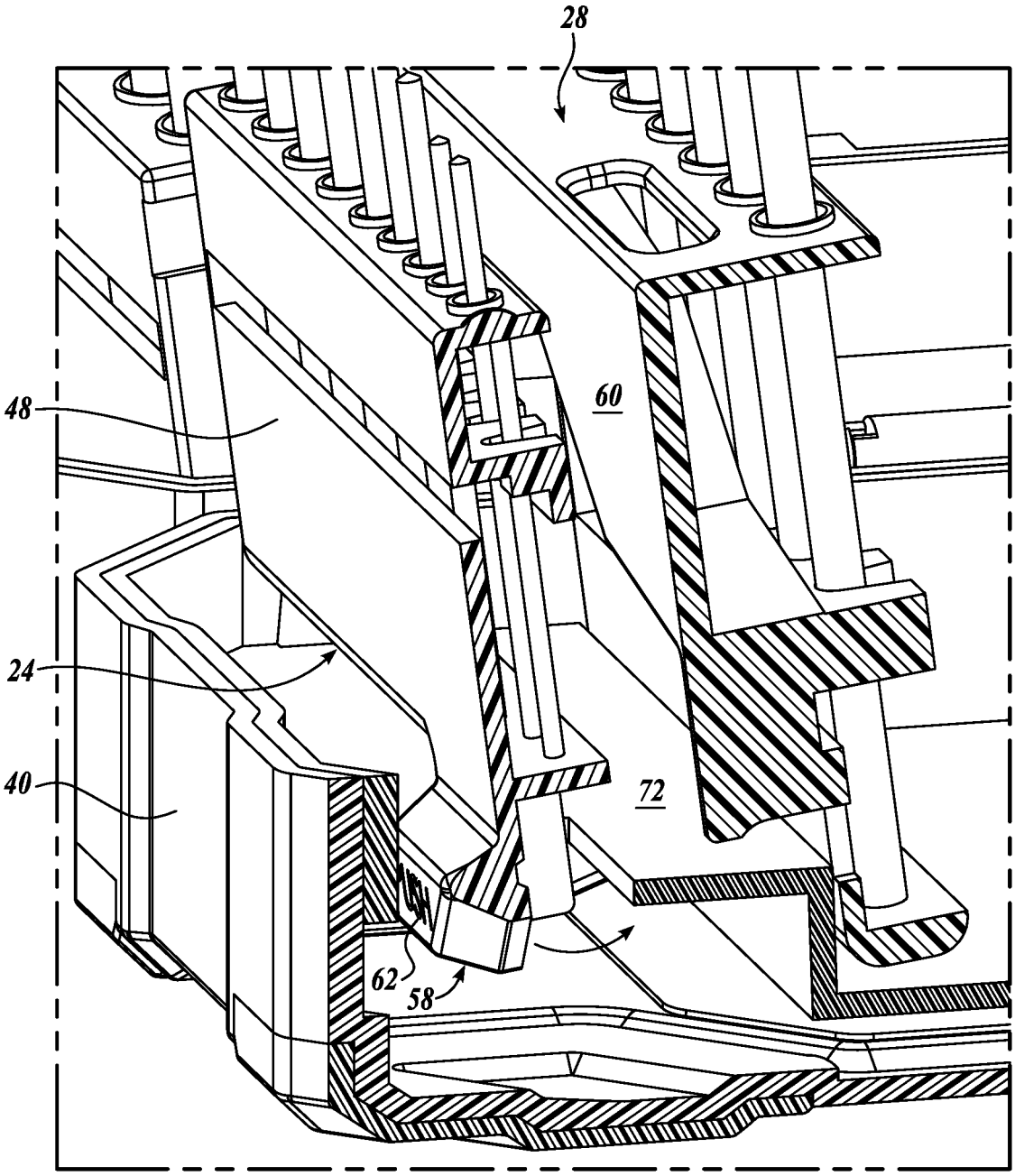
FIG. 3B is a cross-sectional view of a portion of the round shank tool holder assembly of FIG. 1, showing the first and second tip out tool holders moving into the deployed position.

The second and third tip out tool holders 28 and 32 may similarly engage second and third stopping members defined by the first and second housing portions 40 and 44, respectively, to prevent further counterclockwise rotation after they reach an over-center deployed position. For instance, as shown in FIG. 3B, the second tip out tool holder body 60 also engages the first interior raised housing portion 72 when it reaches an over-center deployed position. In this manner, the tip out tool holders 24, 28, and 32 may be displayed in the deployed position with the storage case 36 open (i.e., laying substantially flat on a surface) for easy selection and removal of tools. The second and third tip out tool holders 28 and 32 may include suitable features or assemblies for being moved into the deployed position, such as the finger hold 64 defined in the upper edge of the second tip out tool holder body 60.

Figure 4:
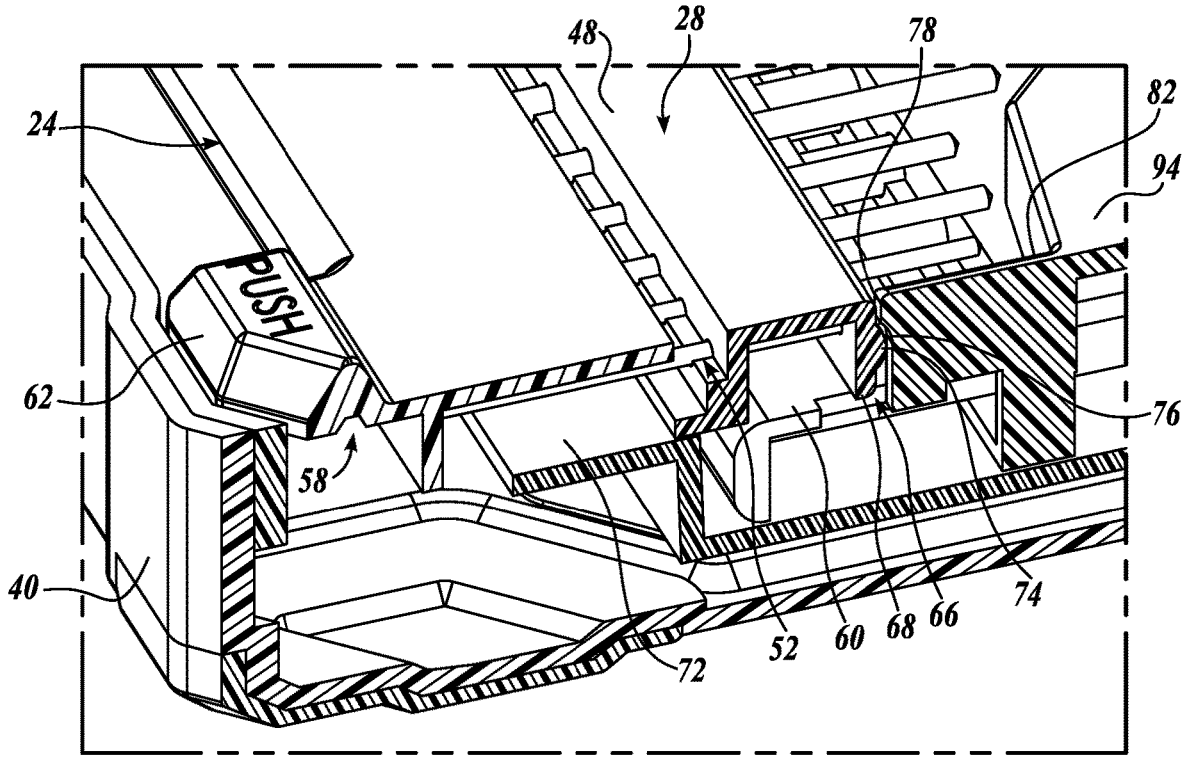
FIG. 4 is a cross-sectional view of a locking assembly and an interference assembly of the round shank tool holder assembly of FIG. 1.

To move the first tip out tool holder 24 back into the stowed position, a user may simply push or move the first body 48 in the opposite clockwise direction about its pivot axis until the first tip out tool holder 24 is in the stowed position. A first locking assembly 66 may be used to selectively secure the first tip out tool holder 24 in the stowed position. The first locking assembly 66 is defined at the upper end of the first tip out tool holder body 48 and the lower end of the second tip out tool holder body 60 to secure the first tip out tool holder 24 in a nested, locking relationship with the second tip out tool holder 28. Although any suitable assembly may be used, in the depicted embodiment (as best seen in FIG. 4), the locking assembly 66 is defined by a locking protrusion 74 extending from the outer surface of the upper edge portion 68 of the first tip out tool holder body 48 that is receivable within a correspondingly-shaped locking detent 76 defined in a bottom edge of a locking piece 82 extending from a raised contoured portion 64 of the second tip out tool holder body 60. The locking protrusion may instead be defined on the locking piece 82 and the detent may be defined on the upper edge portion 68. The upper edge portion 68 of the first tip out tool holder body 48 engages and rests on the second tip out tool holder body 60 to retain the protrusion 74 within the detent 76 and to prevent the first tip out tool holder 24 from moving further clockwise when moved into the stowed position.

To move into locking engagement with the locking detent 76, the locking protrusion 74 passes over an interference portion 78 defined above the locking detent 76 (when the second tip out tool holder 28 is in the stowed position). As such, a snap-fit or tactile sensation is provided to the user when the locking protrusion 74 is moved into engagement with the locking detent 76. The interference between the interference portion 78 and the locking protrusion 74, which defines an interference assembly, also prevents the first tip out tool holder 24 from being moved into the deployed position without application of a predetermined force imposed on the pushbutton 62. More specifically, upon application of a minimum force on the pushbutton 62, the locking protrusion 74 can move past the interference portion 78 so that the first tip out tool holder 24 may be moved into the fully deployed position. In that regard, the first and second tip out tool holder bodies 48 and 60 may be made from a suitably deformable material to allow the locking protrusion 74 to move past the interference portion 78 with application of a minimum force, while at the same time being of a sufficiently rigid material to adequately support the tools.

The interference between the interference portion 78 and the locking protrusion 74 also prevents the second tip out tool holder 28 from being moved into the deployed position when the first tip out tool holder 24 is in the stowed position. More specifically, the interference portion 78 comes into contact with the locking protrusion 74 when the second tip out tool holder 28 is moved about its pivot axis counter-clockwise toward the deployed position. The interference portion 78 cannot move past the locking protrusion 74 to allow the second tip out tool holder 28 to move into the deployed position. In fact, by pulling the second tip out tool holder 28 into the deployed position, the interference between the first and second tip out tool holders 24 and 28 is tightened, ensuring that both remain in the stowed position.

When in the stowed position, the tools T1 are retained axially within the first tip out tool holder body 48 by the second tip out tool holder 28. More specifically, the second tip out tool holder body 60 includes a first tool retention member, or a raised contoured portion 94 defining a first bottom contoured edge 96 that is shaped to substantially correspond to the overall profile of the tools T1 protruding from the first tip out tool holder 24. As can be appreciated by one of ordinary skill, with the tools T1 being of different sizes (such as between 1/16 and 9/64 inches), the tools are correspondingly of different lengths. The decreasingly sized tools T1 create an overall waterfall or terraced profile when received within the first tip out tool holder 24.

The first bottom contoured edge 96 is positioned to engage the tools T1 to substantially prevent axial movement of the tools T1 within the first tip out tool holder 24 when in the stowed position. In that regard, the raised contoured portion 94 is of a predetermined height or depth to define an engagement surface on the first bottom contoured edge 96 for the tools T1 if any axial movement occurs. Moreover, the first bottom contoured edge 96 is spaced a predetermined minimal distance from the distal tip of the tools T1 to prevent substantial axial movement of the tools T1, while still allowing sufficient clearance therebetween, such that the first tip out tool holder 24 can be moved into the deployed position.

By using the second tip out tool holder 28 to axially retain the tools T1 in the first tip out tool holder 24 in the stowed position, the first tip out tool holder 24 can be positioned in a tiered configuration in front of the second tip out tool holder 28 without obscuring the tools (see FIG. 1). More specifically, the tools T1 and T2 remain visible even when the first and second tip out tool holders 24 and 28 are stowed within the storage case 36 (with the storage case 36 open). This allows a user to easily see where the desired tool is located within the round shank tool holder assembly 20 without having to move the tip out tool holders into the deployed position. In addition, the round shank tool holder assembly 20 may be packaged (i.e., with clear plastic) with the storage case 36 in an open configuration to allow a potential purchaser to clearly view all the tools stored within the case. The first and second tip out tool holders 24 and 28 also remain in a tiered configuration in the deployed position, as shown in FIG. 2.

The tools T2 and T3 of the second and third tip out tool holders are similarly retained axially within the second and third tip out tool holders 28 and 32 by second and third tool retention members defined by contoured portions of the first and second housing portions 40 and 44. More specifically, a second raised interior housing portion 100 defines a second bottom contoured edge 108 that is shaped to substantially correspond to the overall profile of the tools T2 protruding from the second tip out tool holder 28. The decreasingly sized tools T2 create an overall waterfall or terraced profile when received within the second tip out tool holder 24.

The second bottom contoured edge 108 is positioned to engage the tools T2 to substantially prevent axial movement of the tools T2 within the second tip out tool holder 28 when in the stowed position. In that regard, the second raised contoured portion 100 is of a predetermined height or depth to define an engagement surface on the second bottom contoured edge 108 for the tools T2 if any axial movement occurs. Moreover, the second bottom contoured edge 108 is spaced a predetermined minimal distance from the distal tip of the tools T2 to prevent substantial axial movement of the tools T1, while still allowing sufficient clearance therebetween, such that the second tip out tool holder 28 can be moved into the deployed position. The tools T3 are retained axially within the third tip out tool holder 32 by a third raised interior housing portion 104 that defines a third bottom contoured edge 112 that is shaped to substantially correspond to the overall profile of the tools T3 protruding from the third tip out tool holder 32.

It should be appreciated that if any of the tip out tool holders are used to retain tools having the same diameter and length, the raised contoured portion 94 of the second tip out tool holder 28 or the second or third raised interior housing portions 100 or 104 may instead define a bottom edge that extends substantially straight across the housing portion. In that regard, the bottom edges of the raised contoured portion 94 or the second or third raised interior housing portions 100 or 104 may be any suitable profile or contour for axially retaining the tools within the tip out tool holders when stowed.

Figure 5:
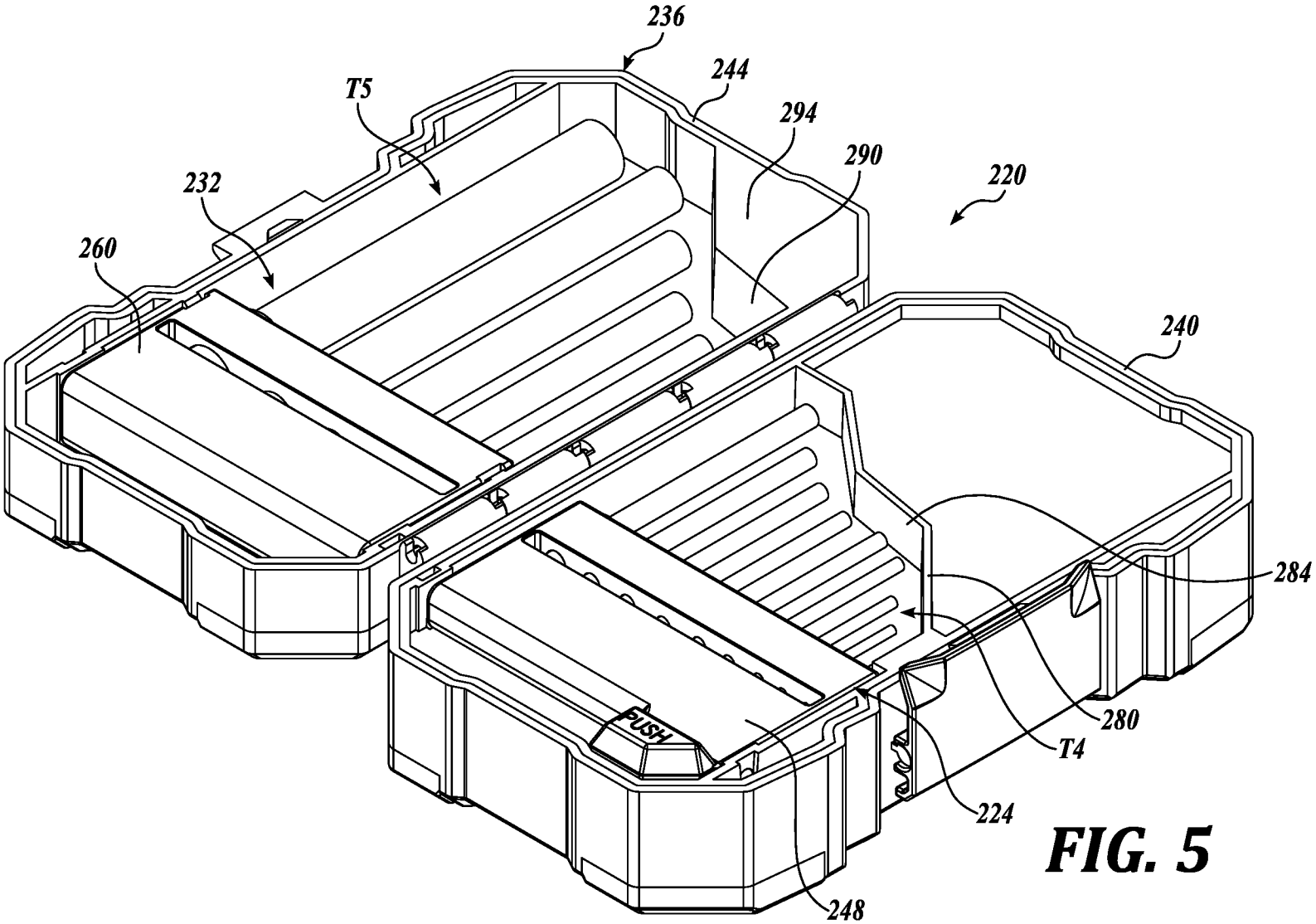
FIG. 5 is an isometric view of a round shank tool holder assembly formed in accordance with a first alternative exemplary embodiment of the present disclosure, wherein tip out tool holders of the round shank tool holder assembly are shown in a stowed position.

Moreover, it should be appreciated that less than three tip out tool holders or more than three tip out tool holders may be secured within the storage case. For instance, in the round shank tool holder assembly 220 depicted in FIG. 5, only two tip out tool holders are used. A first tip out tool holder 224 is pivotally secured within the first housing portion 240 of the storage case 236, and a second tip out tool holder 232 is pivotally secured within the second housing portion 244 of the storage case 236. The first tip out tool holder 224 includes a body 248 that holds tools T4, and the tools T4 are retained axially within the body 248 through a first tool retention member, or a first interior raised housing portion 280 having a bottom edge 284 that is contoured to substantially match the profile of the tools T4 protruding from the body 248. Similarly, the second tip out tool holder 232 includes a body 260 that holds tools T5, and the tools T5 are retained axially within the body 260 through a second tool retention member, or a second interior raised housing portion 290 having a bottom edge 294 that is contoured to substantially match the profile of the tools T5 protruding from the body 260.

The round shank tool holder assembly can also be configured for storing and retaining tools having a maintenance or mechanics length (i.e., shorter in length) rather than a standard length, such as the tools shown in FIGS. 1-5. In that regard, FIGS. 6-8 depict additional alternate embodiments of round shank tool holder assemblies 320 and 420 that are configured for storing and retaining tools having a shorter length.

Figure 6:
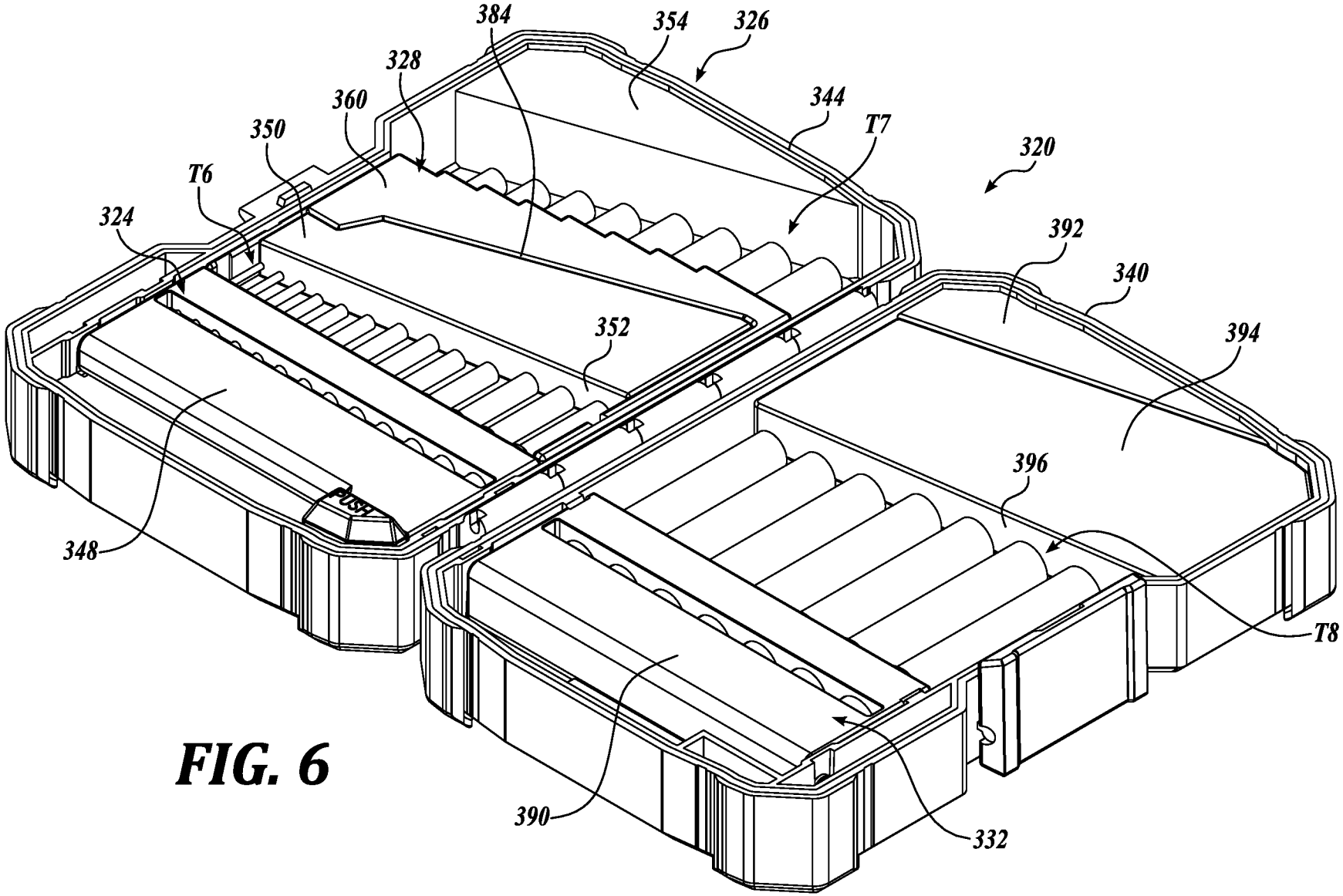
FIG. 6 is an isometric view of a round shank tool holder assembly formed in accordance with a second alternative exemplary embodiment of the present disclosure, wherein tip out tool holders of the round shank tool holder assembly are shown in a stowed position.
Figure 7:
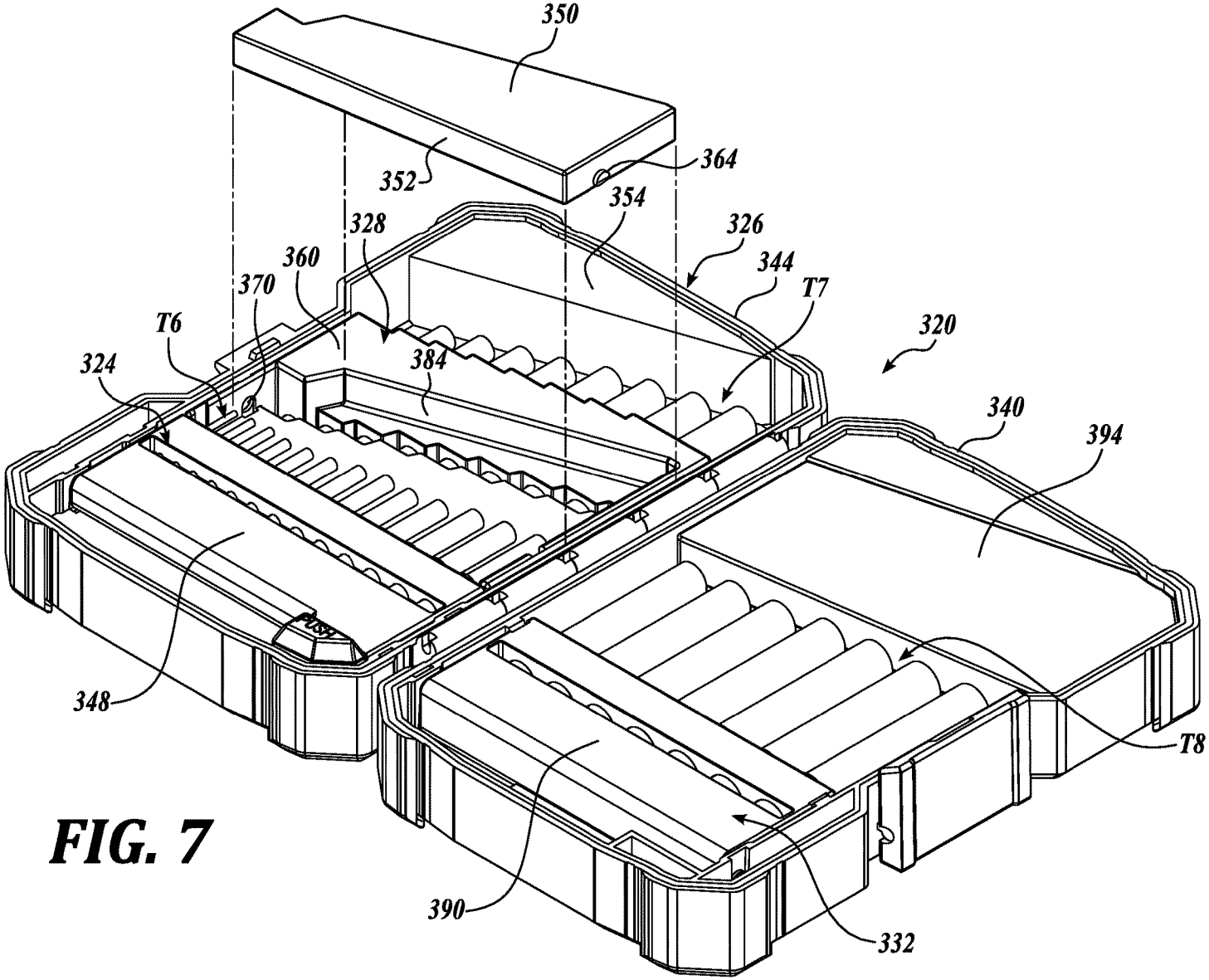
FIG. 7 is an isometric, partially exploded view of the round shank tool holder assembly of FIG. 6.
Figure 8:
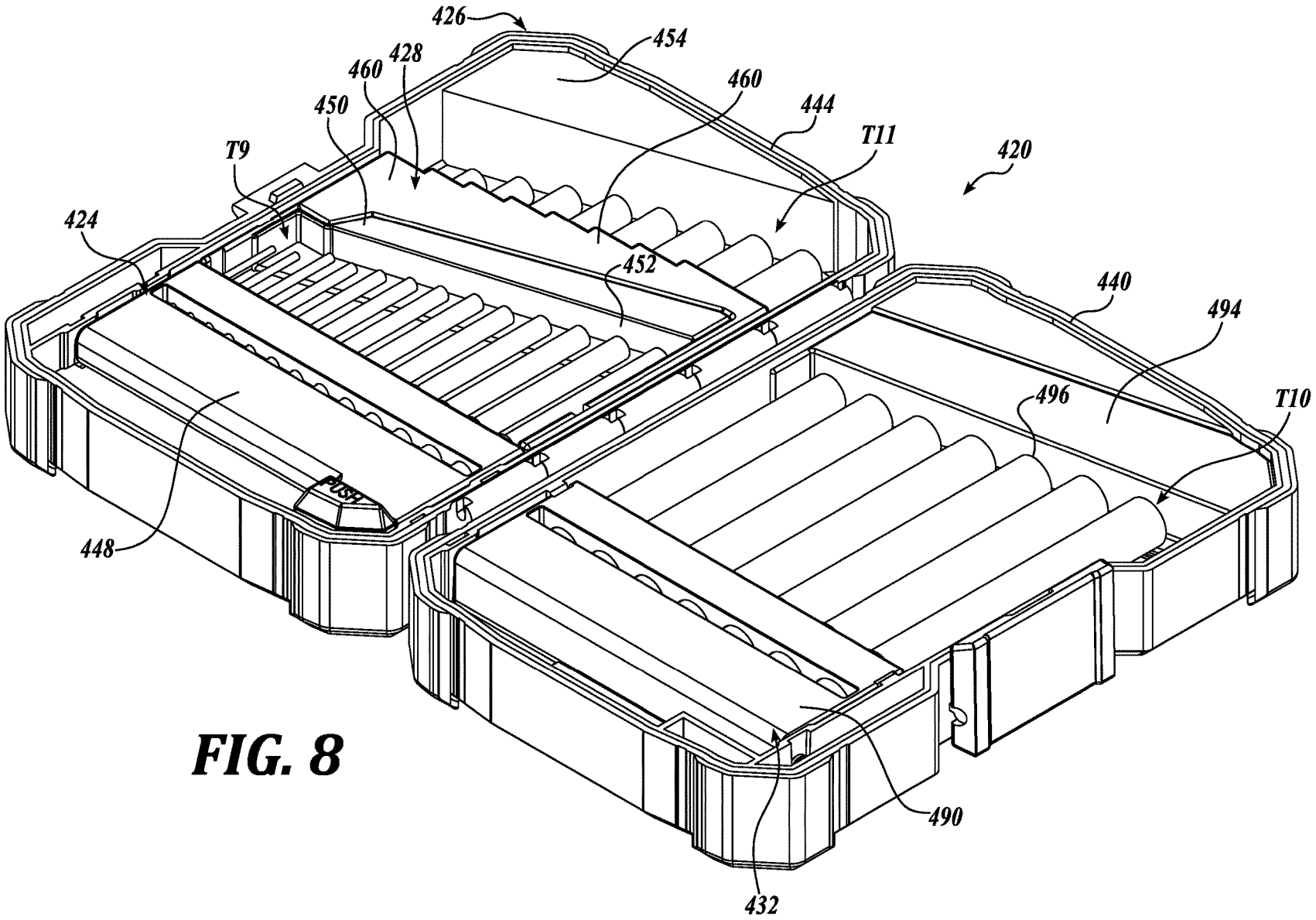
FIG. 8 is an isometric view of a round shank tool holder assembly formed in accordance with a third alternative exemplary embodiment of the present disclosure, wherein tip out tool holders of the round shank tool holder assembly are shown in a stowed position.

Referring specifically to FIGS. 6 and 7, the round shank tool holder assembly 320 includes a third tip out tool holder 332 pivotally secured within the first housing portion 340 of the storage case 336, a first tip out tool holder 324 pivotally secured within the second housing portion 344, and a second tip out tool holder 328 pivotally secured within the second housing portion 344 behind the first tip out tool holder 324 in a manner substantially identical to the first and second tip out tool holders 24 and 28 of the round shank tool holder assembly 20 (except on the opposite side of the storage case).

The first tip out tool holder 324 includes a first body 348 that holds tools T6 that are shorter in length than standard tools. In that regard, a contoured bottom edge 384 of the second tip out tool holder body 360 that would normally function as the first tool retention member may not be suitably contoured or sized to axially retain the tools T6 within the first tip out tool holder 324. In other words, the gap between the contoured bottom edge 384 and the end of the tools T6 may be too great to axially retain the tools T6 in the first tip out tool holder 324.

To fill this gap, a first modular shim block 350 may be secured between the second tip out tool holder body 360 and the tools T6 to define the first tool retention member. The first shim block 350 may be a suitable shape and size such that a bottom block edge 352 substantially matches the profile of the tools T6 protruding from the first tip out tool holder 324. Moreover, the bottom block edge 352 is spaced a predetermined distance from the end of the tools T6 to axially retain the tools T6 in the first tip out tool holder 324 while allowing sufficient clearance for the first tip out tool holder 324 to move into the deployed position. The first shim block 350 may be removably or semi-permanently secured within the second housing portion 344 in a suitable manner, such as with a snap-fit assembly defined by a plurality of lateral protrusions 364 extending from the first shim block 350 (only one shown) receivable within corresponding openings 370 in the second housing portion 344 (only one shown).

The first shim block 350 is modular in nature, meaning that the specific shape/size of the first shim block 350 is chosen depending on the size and overall profile of the tools T6. In that regard, the tool holder 320 may ship to a distributor or customer with multiple shim blocks suitable for different configurations. As yet a further option, the tool holder 320 may ship to a distributor or customer with multiple different tip out tool holders that are configured to be snap-fit within the storage case, which may then be configured with one or more shim blocks suitable for the tools used.

In the embodiment depicted, the third tip out tool holder 332 includes a third body 390 that holds tools T8 that are shorter in length than standard tools. In that regard, a second modular shim block 394 may be secured between an interior raised portion 392 of the first housing portion 340 and the end of the tools T8 to axially retain the tools T8 within the third tip out tool holder 332 and define a third tool retention member. The second modular shim block 394 includes a bottom block edge 396 that substantially matches the profile of the tools T8 protruding from the third tip out tool holder 332. Moreover, the bottom block edge 396 is spaced a predetermined distance from the end of the tools T8 to axially retain the tools T8 in the third tip out tool holder 332 while allowing sufficient clearance for the third tip out tool holder 332 to move into the deployed position.

In this depicted embodiment, the tools T7 within the second tip out tool holder 328 are retained axially therein by a second tool retention member defined by a raised interior portion 354 of the second housing portion 340. However, it should be appreciated that a modular shim block may be used if needed. In that regard, a modular shim block may be used with any of the embodiments described herein. Moreover, as noted above, the specific size and shape of the shim block may be chosen depending on the tools stored within the tip out tool holders.

For instance, the round shank tool holder assembly 420 depicted in FIG. 8 is substantially identical to the tool holder 320 of FIGS. 6 and 7 (with like parts labeled with like reference numerals except in the '400 series) except that the first and second shim blocks 450 and 494 are a different size and shape to accommodate tools T9 and T10, respectively. Thus, it can be appreciated that any configuration may be used.

While illustrative embodiments have been illustrated and described, it will be appreciated that various changes can be made therein without departing from the spirit and scope of the invention.

The embodiments of the invention in which an exclusive property or privilege is claimed are defined as follows:

1. A round shank tool holder assembly, comprising:

a storage case;

a first tip out tool holder configured to removably receive at least a first round shank tool therein, the first tip out tool holder pivotally secured within the storage case and moveable about a first pivot axis between a stowed position and a deployed position, wherein the first round shank tool remains visible in both the stowed and deployed positions;

a second tip out tool holder configured to removably receive at least a second round shank tool therein, the second tip out tool holder pivotally secured within the storage case and moveable about a second pivot axis between a stowed position and a deployed position, wherein the second round shank tool remains visible in both the stowed and deployed positions;

a first tool retention member configured to substantially prevent axial movement of the first round shank tool when the first tip out tool holder is in the stowed position;

a second tool retention member configured to substantially prevent axial movement of the second round shank tool when the second tip out tool holder is in the stowed position; and wherein the first tool retention member is defined at least in part by a first portion of the second tip out tool holder; and an interference assembly configured to substantially prevent the second tip out tool holder from being moved toward the deployed position with the first tip out tool holder in the stowed position, wherein the interference assembly is defined by a portion of the second tip out tool holder that is configured to engage a portion of the first tip out tool holder when the second tip out tool holder is moved toward the deployed position with the first tip out tool holder in the stowed position.

2. The assembly of claim 1, wherein the second round shank tool retention member is defined by a raised interior portion of the storage case.

3. The assembly of claim 1, further comprising a deployment assembly configured to move the first tip out tool holder about the first pivot axis into the deployed position.

4. The assembly of claim 3, wherein the first tip out tool holder includes a first body extending from the first pivot axis and configured to removably receive the first round shank tool, and wherein the deployment assembly includes a pushbutton extending from the first pivot axis opposite the first body.

5. The assembly of claim 1, further comprising a locking assembly configured to selectively lock the first tip out tool holder in the stowed position.

6. The assembly of claim 5, wherein the locking assembly includes a protrusion extending from one of the first tip out tool holder and the second tip out tool holder that is configured to be removably received within a detent defined within the other of the first tip out tool holder and the second tip out tool holder.

7. The assembly of claim 6, wherein the interference assembly includes an interference portion defined on the other of the first tip out tool holder and the second tip out tool holder that is configured to engage the protrusion when the second tip out tool holder is moved toward the deployed position with the first tip out tool holder in the stowed position.

8. The assembly of claim 7, further comprising a deployment assembly configured to move the first tip out tool holder about the first pivot axis into the deployed position.

9. The assembly of claim 1, wherein the first tool retention member includes a shim block disposed between the second tip out tool holder and the first round shank tool.

10. The assembly of claim 1, further comprising a first stopping member configured to substantially prevent the first tip out tool holder from rotating past a first predetermined rotational position when moved into the deployed position and a second stopping member configured to substantially prevent the second tip out tool holder from rotating past a second predetermined rotational position when moved into the deployed position.

11. A tool holder assembly, comprising:

a storage case;

a first tip out tool holder configured to removably receive at least a first tool therein, the first tip out tool holder pivotally secured within the storage case and moveable about a first pivot axis between a stowed position and a deployed position; and a second tip out tool holder configured to removably receive at least a second tool therein, the second tip out tool holder pivotally secured within the storage case and moveable about a second pivot axis between a stowed position and a deployed position; and an interference assembly configured to substantially prevent the second tip out tool holder from being moved toward the deployed position with the first tip out tool holder in the stowed position, wherein the interference assembly is defined by a portion of the second tip out tool holder that is configured to engage a portion of the first tip out tool holder to substantially prevent axial movement of the second tip out tool holder when the first and second tip out tool holders are in the stowed position.

12. The assembly of claim 11, wherein the first and second tools extend from the first and second tip out tool holders, respectively, a predetermined length, and wherein the predetermined length of each of the first and second tools remains substantially visible when the first and second tip out tool holders are in the stowed position.

13. The assembly of claim 11, further comprising a deployment assembly configured to move the first tip out tool holder about the first pivot axis into the deployed position.

14. The assembly of claim 13, wherein the first tip out tool holder includes a first body extending from the first pivot axis and configured to removably receive the first tool, and wherein the deployment assembly includes a pushbutton extending from the first pivot axis opposite the first body.

15. The assembly of claim 11, further comprising a locking assembly configured to selectively lock the first tip out tool holder in the stowed position.

16. The assembly of claim 15, wherein the locking assembly includes a protrusion extending from one of the first tip out tool holder and the second tip out tool holder that is configured to be removably received within a detent defined within the other of the first tip out tool holder and the second tip out tool holder.

17. The assembly of claim 16, wherein the interference assembly is configured to substantially prevent the second tip out tool holder from being moved toward the deployed position with the first tip out tool holder in the stowed position, and wherein the interference assembly includes an interference portion defined on the other of the first tip out tool holder and the second tip out tool holder that is configured to engage the protrusion when the second tip out tool holder is moved toward the deployed position with the first tip out tool holder in the stowed position.

18. The assembly of claim 11, further comprising a first stopping member configured to substantially prevent the first tip out tool holder from rotating past a first predetermined rotational position when moved into the deployed position and a second stopping member configured to substantially prevent the second tip out tool holder from rotating past a second predetermined rotational position when moved into the deployed position.

19. A round shank tool holder assembly, comprising:

a storage case;

a first tip out tool holder configured to removably receive at least a first round shank tool therein, the first tip out tool holder pivotally secured within the storage case and moveable about a first pivot axis between a stowed position and a deployed position, wherein the first round shank tool remains visible in both the stowed and deployed positions;

a second tip out tool holder configured to removably receive at least a second round shank tool therein, the second tip out tool holder pivotally secured within the storage case and moveable about a second pivot axis between a stowed position and a deployed position, wherein the second round shank tool remains visible in both the stowed and deployed positions;

a first tool retention member configured to substantially prevent axial movement of the first round shank tool when the first tip out tool holder is in the stowed position;

a second tool retention member configured to substantially prevent axial movement of the second round shank tool when the second tip out tool holder is in the stowed position; and an interference assembly configured to substantially prevent the second tip out tool holder from being moved toward the deployed position with the first tip out tool holder in the stowed position, wherein the interference assembly is defined by a portion of the second tip out tool holder that is configured to engage a portion of the first tip out tool holder when the second tip out tool holder is moved toward the deployed position with the first tip out tool holder in the stowed position.

* * * * *